US007167663B2

(12) United States Patent
Yoneda et al.

(10) Patent No.: US 7,167,663 B2
(45) Date of Patent: Jan. 23, 2007

(54) SHEET FEEDING DEVICE AND IMAGE FORMING APPARATUS

(75) Inventors: Yoshiharu Yoneda, Nara (JP); Tatsuya Inoue, Nara (JP); Shinji Nakazawa, Kyoto (JP); Shuhji Fujii, Kyoto (JP); Nobuyuki Ueda, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 247 days.

(21) Appl. No.: 10/913,455

(22) Filed: Aug. 9, 2004

(65) Prior Publication Data

US 2005/0047826 A1 Mar. 3, 2005

(30) Foreign Application Priority Data

Aug. 26, 2003 (JP) ..... 2003-301656

(51) Int. Cl.
*G03G 21/00* (2006.01)

(52) U.S. Cl. ..... 399/124; 399/391

(58) Field of Classification Search ..... 399/124
See application file for complete search history.

(56) References Cited

U.S. PATENT DOCUMENTS 4,966,356 A 10/1990 Ohyabu et al.
5,096,181 A * 3/1992 Menon et al. ..... 271/157
5,157,448 A * 10/1992 Lang ..... 399/23
5,253,028 A * 10/1993 Gonda et al. ..... 399/124
5,307,116 A * 4/1994 Ikunami et al. ..... 399/18
5,512,928 A * 4/1996 Kato et al. ..... 347/138
6,089,560 A * 7/2000 Fujiwara ..... 271/4.1
6,549,741 B2 * 4/2003 Miura ..... 399/124
6,674,983 B2 * 1/2004 Enomoto et al. ..... 399/124

FOREIGN PATENT DOCUMENTS

JP 1-98529 A 4/1989
JP 03-120140 A 5/1991
JP 2002-274675 A 9/2002
JP 2002-323833 A 11/2002

* cited by examiner

*Primary Examiner*—David M. Gray
*Assistant Examiner*—Bryan Ready
(74) *Attorney, Agent, or Firm*—Birch, Stewart, Kolasch & Birch, LLP

(57) ABSTRACT

A sheet feeding device for an image forming apparatus can perform various operations. These are, for example, an operation to start an image formation and an output process that inhibits opening and closing of a feeding route interlocked with opening and closing of a storage section. This is done if the received operation or a process executed based on the operation satisfies a preset predetermined condition.

21 Claims, 10 Drawing Sheets

SHEET FEEDING DEVICE AND IMAGE FORMING APPARATUS

CROSS-REFERENCE TO RELATED APPLICATIONS

This non-provisional application claims priority under 35U.S.C. §119(a) on Patent Application No. 2003-301656 filed in Japan on Aug. 26, 2003, the entire contents of which are hereby incorporated by reference.

BACKGROUND OF THE INVENTION

The present invention relates to a sheet feeding device for feeding a sheet to an image forming section via a feeding route from a storage section, such as a manual-feed tray and a paper cassette storing sheets such as copy paper, and image forming apparatuses such as a copying machine and a printer comprising the sheet feeding device, and more particularly relates to a sheet feeding device and an image forming apparatus comprising a plurality of storage sections.

Image forming apparatus such as copying machines and printers are well-known, and such an apparatus comprises a plurality of storage sections such as paper cassettes storing sheets such as copy paper, and a sheet feeding section (sheet feeding device) for feeding a sheet stored in the storage section to an image forming section via a feeding route, and forms an image on the sheet fed to the image forming section from the sheet feeding section.

In particular, in an image forming apparatus called a mid- or high-speed machine with a high image formation speed, a large-capacity storage section for storing a large amount of paper of frequently used size is mounted and connected as an accessory device.

Moreover, in order to prevent complicated feeding routes for feeding sheets from a plurality of storage sections to the image forming section, the image forming apparatus is designed to simplify the feeding routes by using a common feeding route as much as possible.

By simplifying the feeding routes, it is possible to achieve a small-size image forming apparatus and prevent an increase in the costs required for production, distribution and management, and it is also possible to easily remove a sheet in a feeding route in the event of a malfunction such as a paper jam.

As a conventional image forming apparatus, there is disclosed an apparatus in which a feeding route is shared by providing a paper cassette (storage section) storing paper with a paper transport mechanism for guiding paper fed from another paper cassette to a discharge section of paper fed from the paper cassette (see, for example, Japanese Patent Application Laid-Open No. H1-98529).

Further, there is disclosed an apparatus designed to allow easy removal of a sheet material (sheet) stuck in a transport path (feeding route) by opening the transport path in an interlocked manner with pulling out of a feed cassette (storage section) (see, for example, Japanese Patent Application Laid-Open No. 2002-274675).

In the conventional apparatuses, however, during the formation of an image on a sheet stored in one storage section among a plurality of storage sections, for example, when an operator tries to fill another storage section with sheets, the operator has a problem that the other storage section can not be pulled out because the transport path is opened if the storage section is pulled out, and, if the storage section is pulled out by mistake, a problem such as a transport malfunction will occur.

BRIEF SUMMARY OF THE INVENTION

The present invention has been made with the aim of solving the above problems, and the present invention provides a sheet feeding device that enables a storage section to be pulled out even when a sheet is being fed for formation of an image on the sheet by inhibiting opening and closing of the feeding route interlocked with opening and closing the storage section during feeding of the sheet in the feeding route, and to provide an image forming apparatus comprising the sheet feeding device.

A sheet feeding device of the present invention is a sheet feeding device comprising: an opening/closing section capable of being opened and closed; a feeding route for feeding a sheet on which an image is formed, the feeding route capable of being opened and closed in an interlocked manner with opening and closing of the opening/closing section, and is characterized by comprising an inhibition unit for inhibiting opening and closing of the feeding route interlocked with opening and closing of the opening/closing section when a predetermined condition is satisfied.

In the sheet feeding device of the present invention, by inhibiting opening and closing of the feeding route interlocked with opening and closing of the opening/closing section when a predetermined condition is satisfied, it is possible to open and close the opening/closing section to perform some work for the inside of the device, without affecting the feeding route.

The sheet feeding device of the present invention is characterized in that the predetermined condition is a condition indicating feeding of a sheet in the feeding route.

In the sheet feeding device of the present invention, by inhibiting opening and closing of the feeding route interlocked with opening and closing of the opening/closing section when a sheet such as copy paper is being fed in the feeding route, it is possible to open and close the opening/closing section even during feeding, and it is also possible to prevent a feeding malfunction due to opening and closing of the opening/closing section.

The sheet feeding device of the present invention is characterized in that the feeding route is a route used for feeding a sheet from a first storage section storing sheets to an image forming section for forming an image on a sheet, and the opening/closing section capable of being opened and closed is a second storage section different from the first storage section and capable of being pulled out and pushed in.

According to the sheet feeding device of the present invention, in a sheet feeding device incorporated in an image forming apparatus such as a copying machine and a printer machine comprising a plurality of storage sections for storing sheets, by inhibiting a feeding route for feeding a sheet stored in the first storage section from being opened/closed in an interlocked manner with pulling out/pushing in the second storage section that is the opening/closing section, it is possible to perform an operation such as filling the second storage section with the sheets even when an image formation and output process using a sheet stored in the first storage section is being carried out, and it is also possible to prevent opening of the feeding route even when the second storage section is opened by mistake and prevent a feeding malfunction.

A sheet feeding device of the present invention further comprises a detector for detecting malfunctions, and is characterized in that the inhibition unit removes the inhibition of the feeding route when the detector detects a malfunction.

In the sheet feeding device of the present invention, by removing the inhibition of the interlocked action when a malfunction such as a feeding malfunction occurs, the feeding route opens and closes in an interlocked manner with opening/closing of the opening/closing section, and therefore it is possible to easily perform a restoration operation against the malfunction.

The sheet feeding device of the present invention is characterized in that the feeding route comprises a fixed stationary plate and a movable plate mounted swingably on the stationary plate at one end, and the feeding route opens and closes by moving other end of the movable plate apart from or to come into contact with the stationary plate.

In the sheet feeding device of the present invention, since the feeding route opens and closes by moving the movable plate mounted swingably on the stationary plate at one end apart from or to come into contact with the stationary plate in an interlocked manner with opening/closing of the opening section, it is possible to easily remove the sheet which caused a malfunction such as a paper jam from the space between the separated stationary plate and movable plate constituting the feeding route.

An image forming apparatus of the present invention is characterized by comprising the above-described sheet feeding device; and a section for forming an image on a sheet fed by the sheet feeding device.

According to the image forming apparatus of the present invention, in an image forming apparatus such as a copying machine and a printer comprising a sheet feeding device for feeding a sheet such as copy paper, when a predetermined condition is satisfied, by inhibiting opening and closing of the feeding route interlocked with opening and closing of the opening/closing section, it is possible to open and close the opening/closing section to perform some work for the inside of the device, without affecting the feeding route.

In the sheet feeding device and the image forming apparatus of the present invention, since not only the feeding route for feeding a sheet from the first storage section storing sheets such as copy paper to the image forming section opens and closes in an interlocked manner with opening/closing (pulling out/pushing in) of the second storage section, but also opening and closing of the feeding route interlocked with opening and closing of the second storage section is inhibited when a sheet is being fed in the feeding route, the apparatus and device have advantages effects, for example, even when the second storage section is opened (pulled out) during feeding of the sheet stored in the first storage section, it is possible to perform the operation of filling the second storage section with the sheets without causing a feeding malfunction due to opening of the feeding route.

According to the sheet feeding device and the image forming apparatus of the present invention, since the inhibition is removed when the detector for detecting malfunctions such as a feeding malfunction due to a paper jam detects a malfunction, the feeding route opens by opening the second storage section in the event of a malfunction, and therefore it is possible to easily perform a restoration operation against the malfunction which requires opening and closing of the feeding route. In particular, if the device is designed using a solenoid as the inhibition unit so that the interlocked action is inhibited when the solenoid is energized, it is possible to realize an inhibition removing function in the event of malfunctions even for a malfunction such as a blackout, and, it is also possible to provide advantageous effects, for example, saving power because electromagnetic means such as the solenoid is not energized in a state where feeding has not been started.

The above and further objects and features of the invention will more fully be apparent from the following detailed description with accompanying drawings.

DETAILED DESCRIPTION OF THE INVENTION

Figure 1:
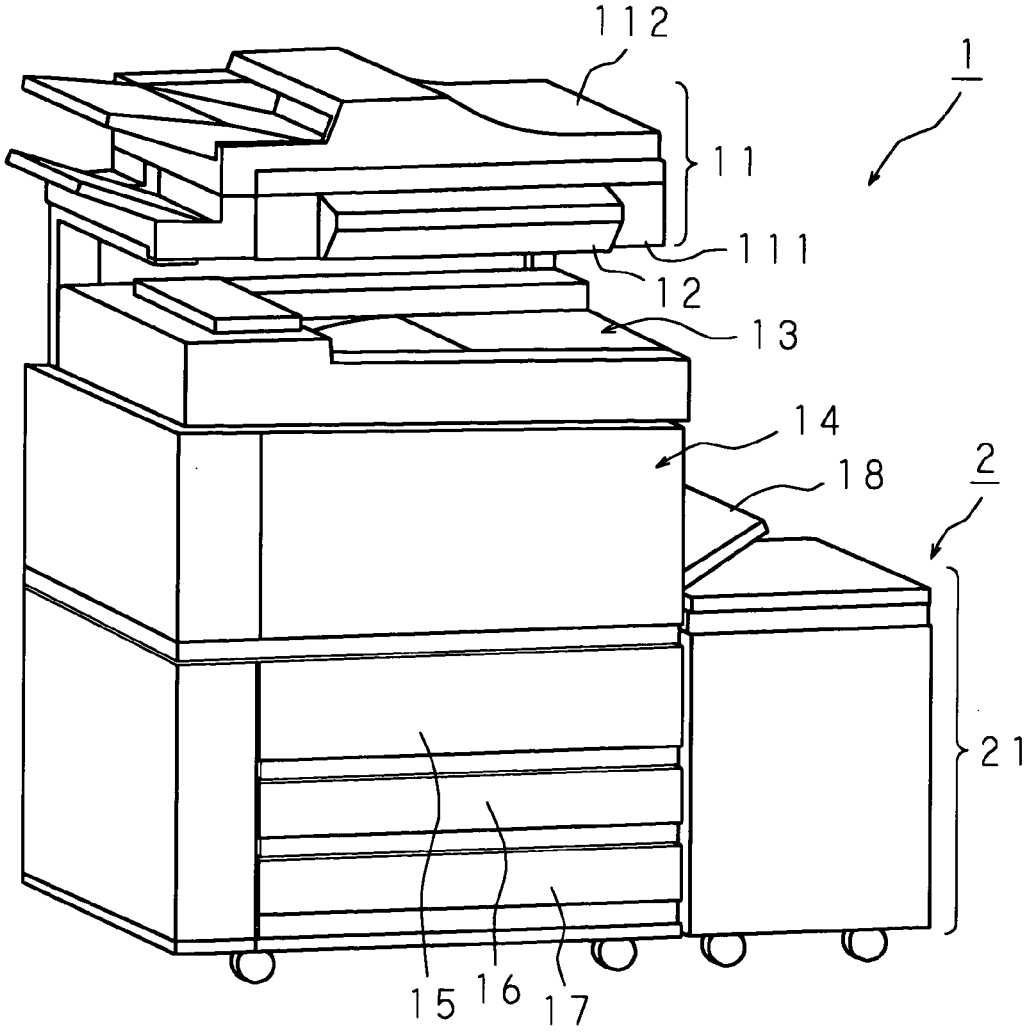
FIG. 1 is a perspective view showing the appearance of an image forming apparatus of the present invention.

The following description will explain in detail the present invention, based on the drawings illustrating an embodiment thereof. FIG. 1 is a perspective view showing the appearance of an image forming apparatus of the present invention. In FIG. 1, numeral 1 represents an image forming apparatus of the present invention, such as a copying machine and a printer, comprising a sheet feeding device of the present invention. The image forming apparatus 1 has a rectangular parallelepiped shape and a reading device (reading section) 11 for reading an image of a placed document is disposed in an upper part of the image forming apparatus 1.

The reading device 11 comprises a fixed reading table 111, and an opening/closing cover 112 attached to the reading table 111 so that it is freely opened/closed. The opening/closing cover 112 has a document tray for placing a document thereon, and a document placed on the document tray is fed onto a glass surface (not shown) of the reading table 111 covered with the opening/closing cover 112 in FIG. 1 and read through the glass surface.

An operating section 12 that is a man-machine interface for operating the image forming apparatus 1 is mounted on the front side of the reading device 11, and a discharge section 13 from which a sheet on which an image is formed is discharged is provided under the reading device 11. An opening/closing door 14 is provided under the discharge section 13, so that it is possible to handle malfunctions such as a paper jam occurred inside the image forming apparatus 1 by opening the opening/closing door 14.

Three levels of storage sections 15, 16 and 17 that are opening/closing sections are provided further below the opening/closing door 14 as storage sections (opening/closing sections) such as paper cassettes for storing sheets and capable of being pulled out/pushed in (opened/closed). When an operator pulls out the storage sections 15, 16 and 17 forward, the storage sections 15, 16 and 17 are opened so that the operation of supplying sheets can be performed.

A manual-feed tray 18 on which a small amount of sheets is to be placed is mounted on the right-side face of the image forming apparatus 1.

An accessory device 2 having a storage section 21 capable of storing a large amount of sheets is provided on the right side of the image forming apparatus 1.

In the following explanation, the storage section 21 of the accessory device 2 is referred to as the first storage section 21, and the storage sections 15, 16 and 17 of the image forming apparatus 1 are referred to as the second storage section 15, third storage section 16 and fourth storage section 17, respectively. Although FIG. 1 illustrates an example of an embodiment in which the accessory device 2 is attached to the image forming apparatus 1, it may also be possible to integrate the image forming apparatus 1 and the accessory device 2.

Figure 2:
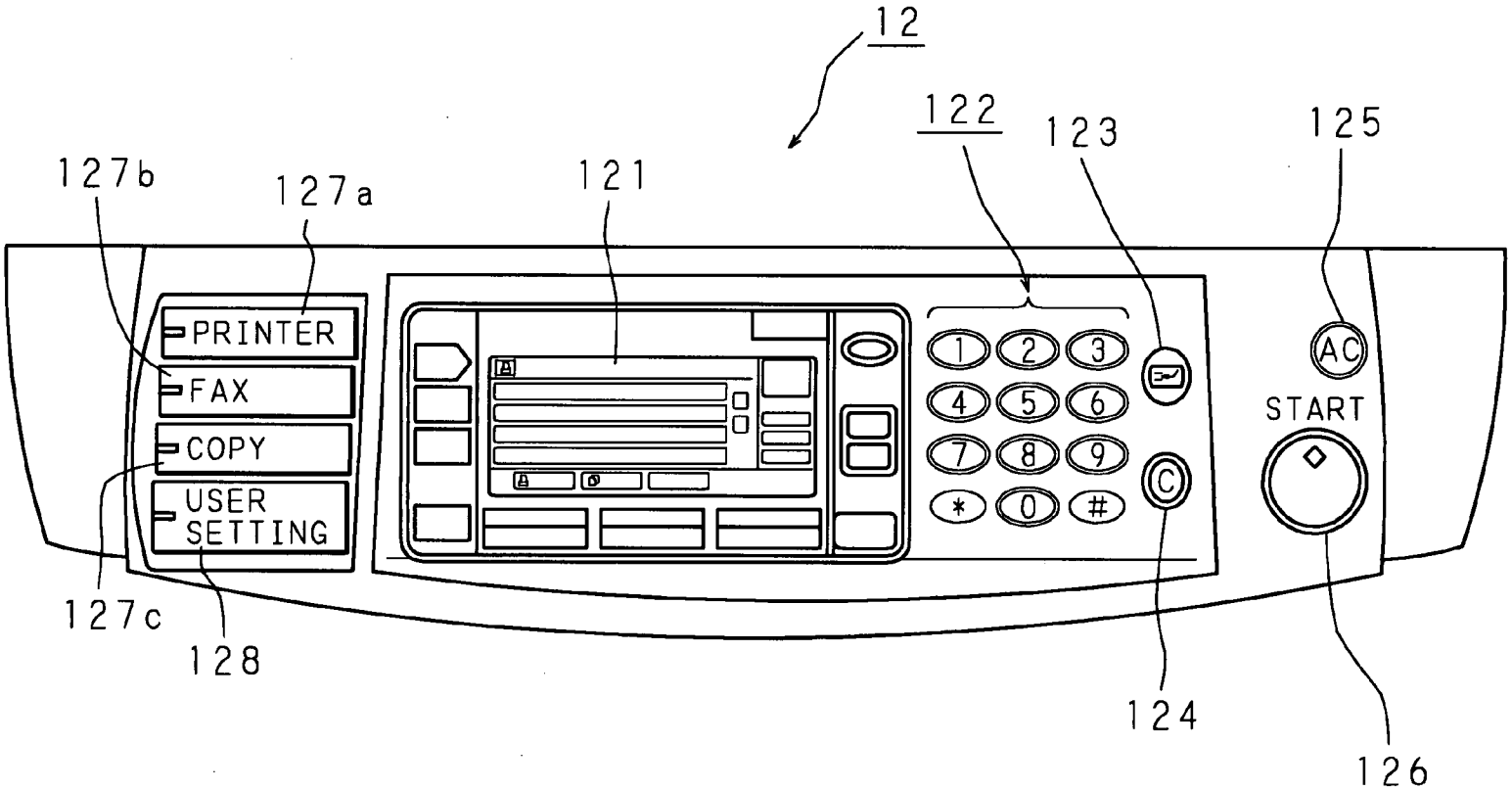
FIG. 2 is an outside view showing an operating section of the image forming apparatus of the present invention.

FIG. 2 is an outside view showing the operating section 12 of the image forming apparatus 1 of the present invention. A liquid crystal display section 121 that is an input/output interface composed of an input section such as a transparent touch panel for receiving operations of an operator and a display section such as a dot matrix type liquid crystal panel is provided near the center of the operating section 12. The liquid crystal display section 121 transmits information to the operator by displaying the information, and the image forming apparatus 1 receives an operation when the operator touches a location indicated by the displayed image.

Numeric keys 122 for inputting numeric values such as the number of copies and a facsimile number are provided on the right side of the liquid crystal display section 121; an interruption key 123 for temporarily interrupting the process being executed and performing other process is provided on the upper right side of the numeric keys 122; and a clear key 124 for clearing numeric values displayed in the liquid crystal display section 121 and interrupting a process is provided on the lower right side of the numeric keys 122.

Moreover, an all-cancel key 125 for returning various settings inputted by the operator to the standard settings is provided on the right side of the interruption key 123; and a start key 126 for starting a process such as an image formation and output process by copying a document is provided under the all-cancel key 125.

Further, provided on the left side of the liquid crystal display section 121 are a switching key 127*a* for calling the printer function; a switching key 127*b* for calling the facsimile (fax) function; a switching key 127*c* for calling the copying (copy) function; and a user setting key 128 used for making various settings.

Figure 3:
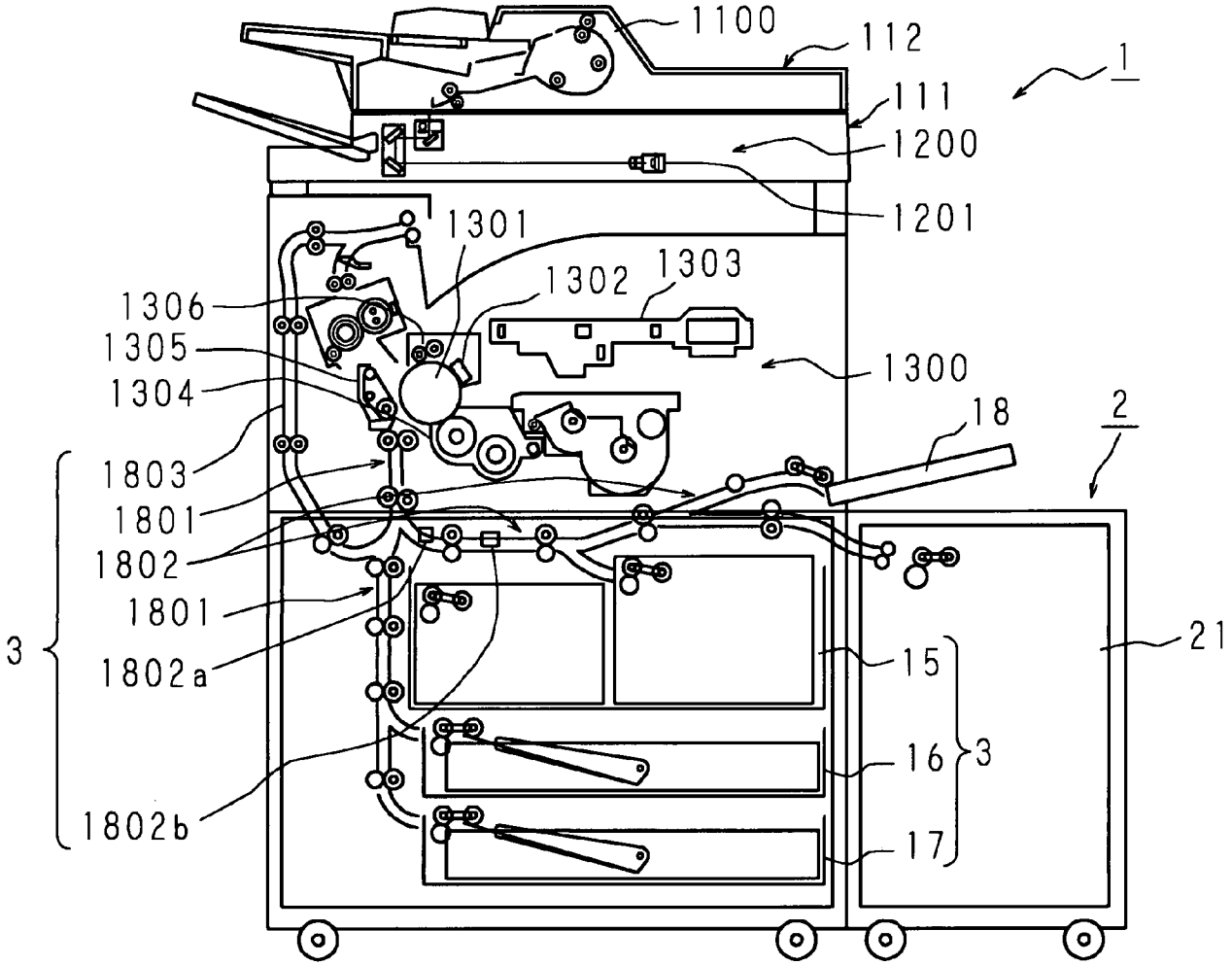
FIG. 3 is a schematic view showing the internal structure of the image forming apparatus of the present invention.

FIG. 3 is a schematic view showing the internal structure of the image forming apparatus 1 of the present invention. A feeding mechanism 1100 for feeding a document placed on a document tray onto the glass surface of the reading table 111 is provided in the opening/closing cover 112. The image shown in the document fed onto the glass surface by the feeding mechanism 1100 is optically read by a reading mechanism 1200 which is provided in the reading table 111 and comprises a light source, reflecting mirrors and a reading element 1201 using a CCD (Charge Coupled Device).

The image forming apparatus 1 has an image forming section 1300 for forming an image on a sheet, based on the image read by the reading mechanism 1200. The image forming section 1300 comprises a cylindrical photosensitive drum 1301; a charging unit 1302 for uniformly charging the photosensitive drum 1301; a light scanning unit 1303 for writing an electrostatic latent image on the uniformly charged photosensitive drum 1301 by scanning an optical image based on the image read by the reading mechanism 1200; a development unit 1304 for reproducing the electrostatic latent image written on the photosensitive drum 1301 by the light scanning unit 1303 by using a developer; a transfer unit 1305 for performing a transfer process to form an image on a sheet, based on the electrostatic latent image reproduced on the photosensitive drum 1301; and a cleaning unit 1306 for removing the developer remaining on the photosensitive drum 1301.

The second storage section 15, third storage section 16 and fourth storage section 17 are disposed under the image forming section 1300. The second storage section 15 is a large-capacity storage section for storing two types of sheets side by side, while each of the third storage section 16 and the fourth storage section 17 stores one type of sheet.

The image forming apparatus 1 comprises a first feeding route 1801 as a vertical path for feeding a sheet stored in each of the third storage section 16 and fourth storage section 17 to the photosensitive drum 1301 and further feeding the sheet on which an image was formed at the photosensitive drum 1301 to the discharge section 13.

Moreover, the image forming apparatus 1 comprises a second feeding route 1802 as a horizontal path provided above the second storage section 15. The second feeding route 1802 is the route for feeding a sheet placed on the manual-feed tray 18 and a sheet stored in the first storage section 15 of the first accessory device 2 to the first feeding route 1801. The second feeding route 1802 is shared for feeding the sheets stored in the manual-feed tray 18 and in the first storage section 21.

One of the two types of sheets placed side by side in the second storage section 15 is fed to the image forming section 1300 via the first feeding route 1801, while the other is fed to the image forming section 1300 from the second feeding route 1802 via the first feeding route 1801.

Moreover, the second feeding route 1802 includes a feed detecting section 1802*a* for detecting whether or not a sheet is present in a location just before the connection to the first feeding route 1801, so that it is possible to detect whether or not a sheet that is fed via the second feeding route 1802 has passed through the second feeding route 1802.

Further, the second feeding route 1802 includes malfunction detecting means 1802*b* for detecting malfunctions such as a paper jam, and has a structure capable of being opened and closed so as to remove the stuck sheet in the event of a malfunction.

In addition, the image forming apparatus 1 comprises a third feeding route 1803 connected to the first feeding route 1801 in a ring form, and a sheet on which an image was formed at the image forming section 1300 is fed to the third feeding route 1803 by a switch-back mechanism and then fed to the first feeding route 1801 again in the state of being reversed so as to form an image on the back side in the image forming section 1300. In short, the third feeding route 1803 is a route used for double-side printing.

Various storage sections such as the second storage section 15, third storage section 16 and fourth storage section 17, various feeding routes such as the first feeding route 1801, second feeding route 1802 and third feeding route 1803, and accessory devices in the feeding routes such as the feed detecting section 1802*a* and malfunction detecting means 1802*b* form a sheet feeding device (sheet feeding section) 3 for feeding a sheet such as copy paper to the image forming section 1300.

Figure 4A:
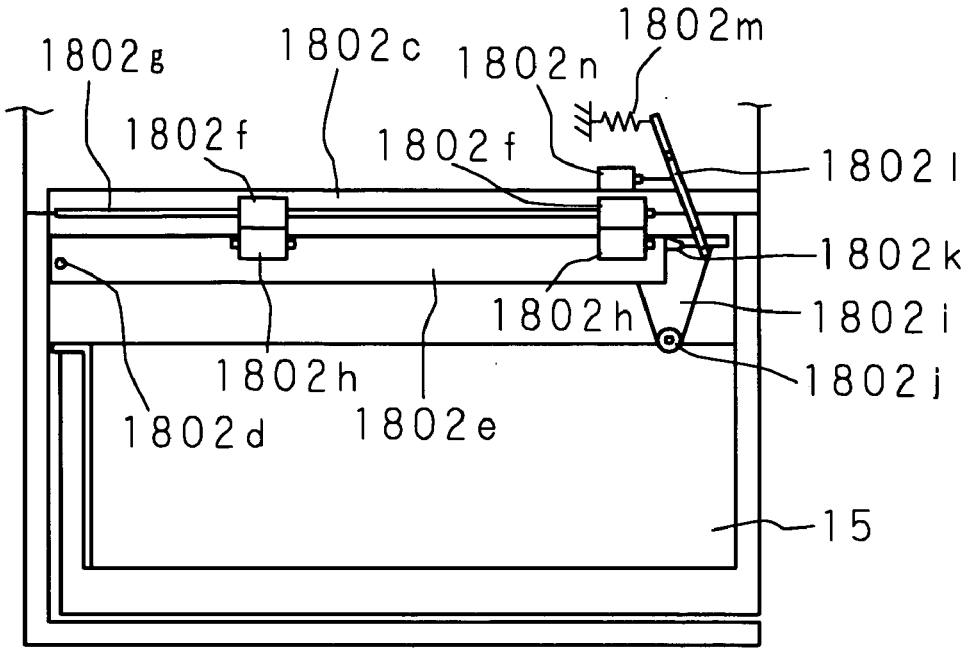
FIG. 4A and FIG. 4B are schematic views showing the cross sections, seen from a side, of a second storage section and a second feeding route constituting a sheet feeding device of the image forming apparatus of the present invention.
Figure 4B:
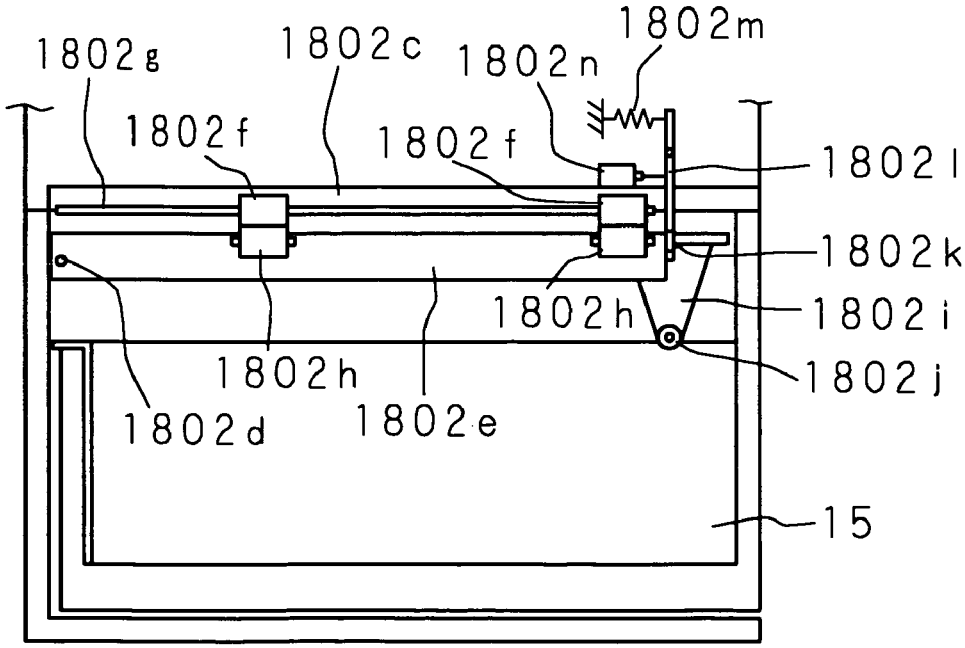

FIG. 4A, FIG. 4B and FIG. 5A, FIG. 5B are schematic views showing the cross sections, seen from a side, of the second storage section 15 and the second feeding route 1802 constituting the sheet feeding device 3 of the image forming apparatus 1 of the present invention. FIG. 4A and FIG. 4B are schematic views showing a state in which the second storage section 15 is pushed into the image forming apparatus 1 and closed, wherein FIG. 4A shows an unlocked state allowing opening and closing, and FIG. 4B shows a locked state inhibiting opening and closing.

The second feeding route 1802 comprises a stationary plate 1802*c* fixed in the sheet feeding device 3 of the image forming apparatus 1, and a movable plate 1802*e* mounted swingably on the stationary plate 1802 at one end with a swing support 1802*d*. When the movable plate 1802*e* swings on the swing support 1802*d*as a fulcrum and the other end of the movable plate 1802 moves apart from/comes into contact with the stationary plate 1802*c*, the second feeding route 1802 opens and closes.

Moreover, the stationary plate 1802*c* is provided with a spindle 1802*g* having a pair of transport rollers 1802*f* and 1802*f* for supplying power to transport a sheet. The movable plate 1802*e* has a pair of driven rollers 1802*h* and 1802*h* which come into contract with the transport rollers 1802*f* and 1802*f* and rotate when the second feeding route 1802 is closed.

Further, provided on the other end of the movable plate 1802*e* is a triangular contact member 1802*i* with one side parallel to the movable plate 1802*e* and a vertex opposite the one side being located in a lower position in the closed state, and, as shown in FIG. 4A and FIG. 4B, the lower vertex is in contact with the second storage section 15.

In the contact member 1802*i*, a disk-shaped rotatable roller member 1802*j* is provided at the position of the vertex in contact with the second storage section 15, and two sides forming the vertex are formed as sides smoothly sloping outward.

In addition, a protruding portion 1802*k* used for inhibiting opening and closing of the second feeding route 1802 is provided on the other end of the movable plate 1802*e*. When one end of a lock lever 1802*l* mounted swingably is locked with the protruding portion 1802*k*, the movable plate 1802*e* is fixed and opening and closing of the second feeding route 1802 are inhibited.

Connected to the other end of the lock lever 1802*l* is a spring 1802*m* made of a stainless steel material or piano wire for applying a force in a direction of removing the locked protruding portion 1802*k* and allowing the second feeding route 1802 to be opened/closed. A solenoid 1802*n* is connected near the mid point of the lock lever 1802*l*, and the fulcrum of the lock lever 1802*l* is provided between the other end and the point connected to the solenoid 1802*n*.

With such structures, in the second feeding route 1802, as shown in FIG. 4A, when the solenoid 1802*n* is not energized, the protruding portion 1802*k* protruding from the other end of the movable plate 1802*e* is released from the lock lever 1802*l* by the force of the spring 1802*m*, and consequently the movable plate 1802*e* is brought into a swingable state and the second feeding route 1802 can open/close.

On the other hand, as shown in FIG. 4B, in a state in which the solenoid 1802*n* is energized, since the plunger of the solenoid 1802*n* is attracted by an electromagnetic force, one end of the lock lever 1802*l* is pulled by the solenoid 1802*n* and consequently the protruding portion 1802*k* is locked with the lock lever 1802*l*, so that the movable plate 1802 is fixed and opening and closing of the second feeding route 1802 are inhibited. In short, the protruding portion 1802*k*, lock lever 1802*l*, spring 1802*m* and solenoid 1802*n* function as an inhibition unit for inhibiting opening and closing of the second feeding route 1802. The inhibition unit may be formed by members other than those mentioned above.

Figure 5A:
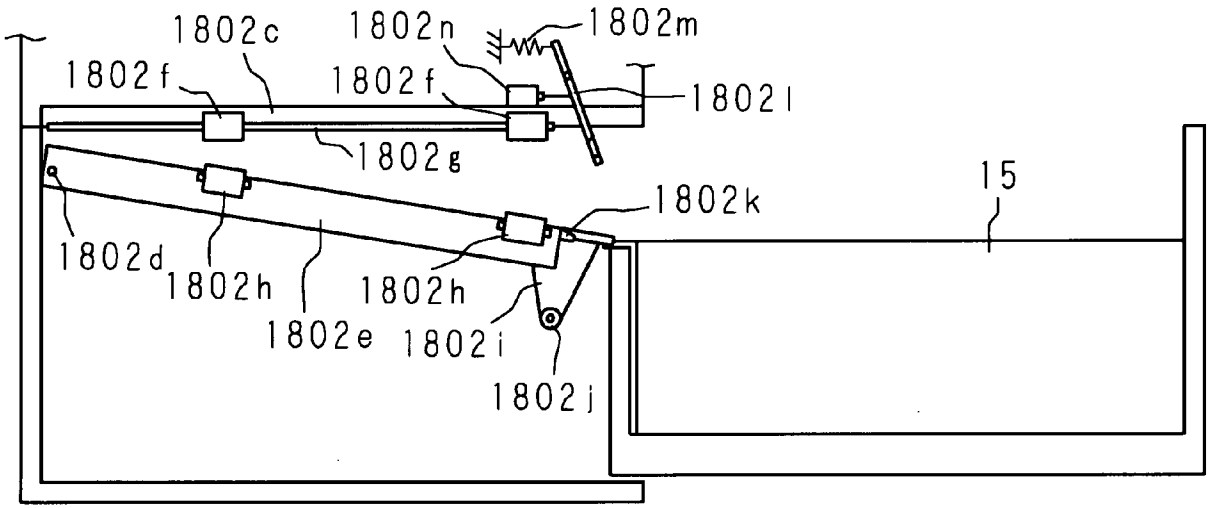
FIG. 5A and FIG. 5B are schematic views showing the cross sections, seen from a side, of the second storage section and the second feeding route constituting the sheet feeding device of the image forming apparatus of the present invention.
Figure 5B:
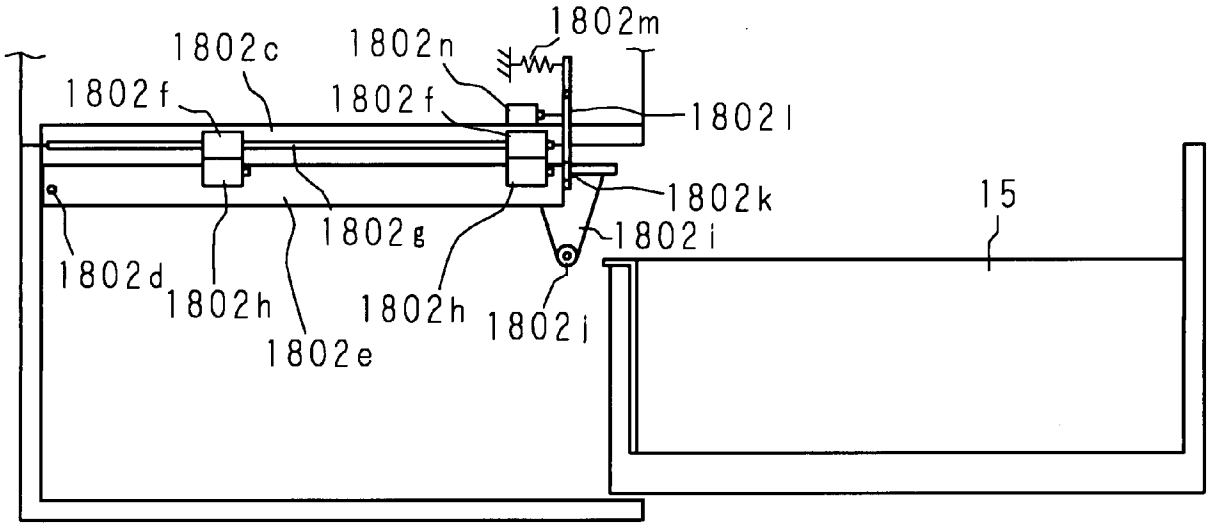

FIG. 5A and FIG. 5B are schematic views showing a state in which the second storage section 15 is pulled out from the sheet feeding device 3, wherein FIG. 5A shows an unlocked state allowing opening and closing, and FIG. 5B shows a locked state inhibiting opening and closing.

FIG. 5A shows a state in which the second storage section 15 is opened by being pulled out in the right direction in the drawing from the state shown in FIG. 4A. When the second storage section 15 is pulled out, since the contact member 1802*i* provided on the other end of the movable plate 1802*e* can not make contact with the second storage section 15 that is an object of contact for the rolling member 1802*j*, the contact member 1802*i*moves down, i.e., the movable plate 1802*e* swings down on the swing support 1802*d* as a fulcrum, and consequently the other end of the movable plate 1802*e* moves apart from the stationary plate 1802*c* and the second feeding route 1802 is opened.

Since the first feeding route 1802*e* is opened, if a malfunction such as a paper jam has occurred in the first feeding route 1802*e*, it is possible to easily remove the sheet causing the paper jam. Thus, in the unlocked state, the second feeding route 1802 opens and closes in an interlocked manner with opening and closing of the second storage section 15 that is the opening/closing section.

FIG. 5B shows a state in which the second storage section 15 is pulled out by pulling it in the right direction in the drawing from the state shown in FIG. 4B. When the second storage section 15 is pulled out, the contact member 1802*i* provided on the other end of the movable plate 1802*e* can not make contact with the second storage section 15 that is an object of contact for the rolling member 1802*j*, but, since the protruding portion 1802*k* protruding from the other end of the movable plate 1802*e* is locked with the lock lever 1802*l*, the movable plate 1802*e* can not swing and remains fixed. Thus, in the locked state in which opening and closing of the second feeding route 1802 are inhibited, opening and closing of the second feeding route 1802 interlocked with opening and closing of the second storage section 15 that is the opening/closing section are inhibited.

Figure 6A:
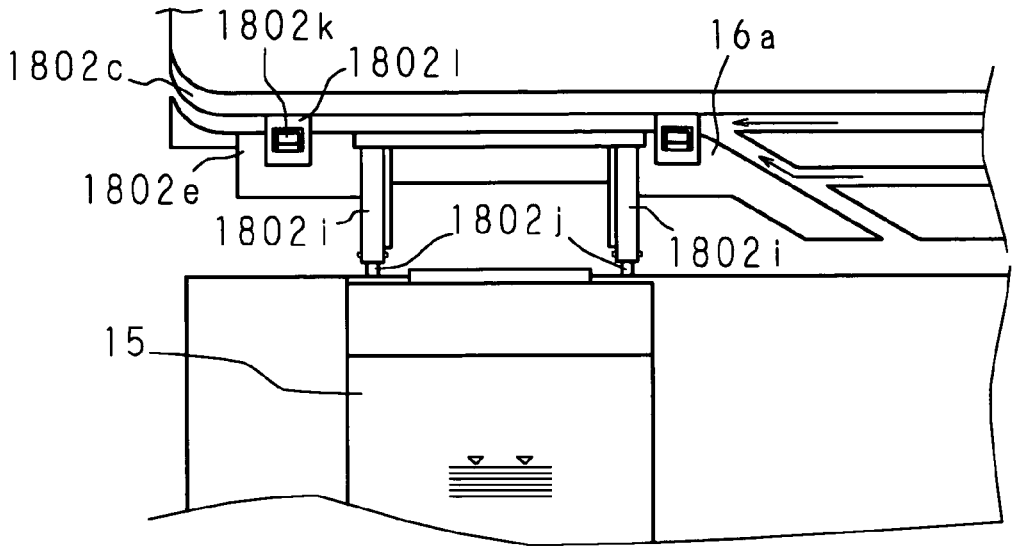
FIG. 6A and FIG. 6B are schematic views showing the cross sections, seen from the front, of the second storage section and the second feeding route constituting the sheet feeding device of the image forming apparatus of the present invention.
Figure 6B:
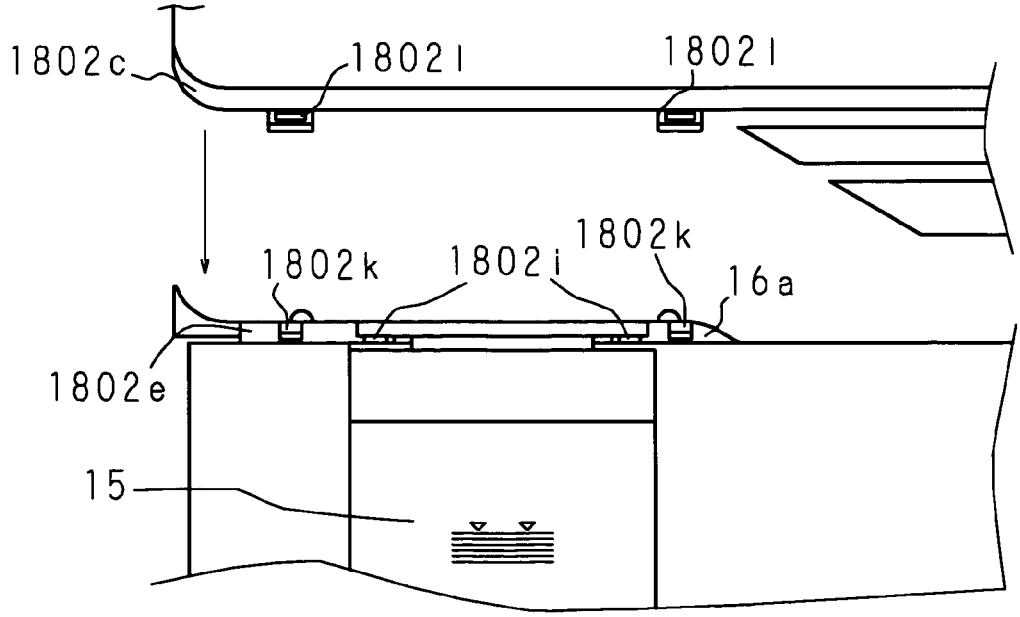

FIG. 6A and FIG. 6B are schematic views showing the cross sections, seen from the front, of the second storage section 15 and the second feeding route 1802 constituting the sheet feeding device 3 of the image forming apparatus 1 of the present invention. FIG. 6A and FIG. 6B show an unlocked state in which an inhibition using the inhibition unit is not performed, wherein FIG. 6A shows a state in which the second storage section 15*a* is closed, and FIG. 6B shows a state in which the second storage section 15*a* is opened. It can be confirmed from FIG. 6A that the second feeding route 1802 is formed by the stationary plate 1802*c* and the movable plate 1802*e*, and it can be confirmed from FIG. 6B that the other end of the movable plate 1802*e* is moved down and the second feeding route 1802 opens as the movable plate 1802*c* swings.

Figure 7:
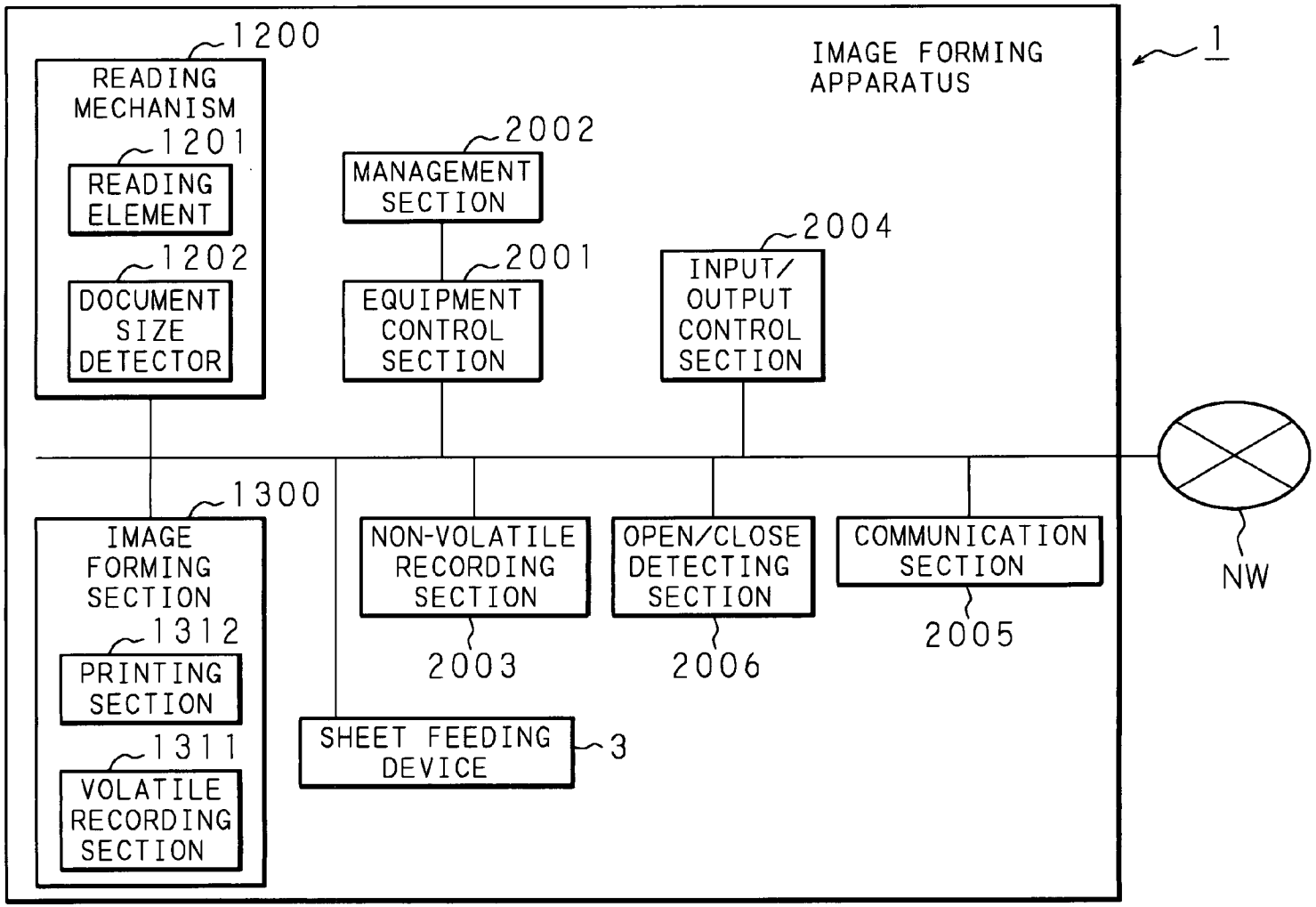
FIG. 7 is a block diagram showing the control structure of the image forming apparatus of the present invention.

FIG. 7 is a block diagram showing the control structure of the image forming apparatus 1 of the present invention. The image forming apparatus 1 such as a copying machine and a facsimile machine comprises an equipment control section 2001 such as a CPU for controlling the entire apparatus, and a management section 2002 for managing information about the respective mechanisms controlled by the equipment control section 2001. The equipment control section 2001 operates as the image forming apparatus 1 of the present invention by controlling the entire apparatus including the sheet feeding device 3, based on the information managed by the management section 2002.

The image forming apparatus 1 comprises a reading mechanism 1200 including a reading element 1201 using a CCD for reading an image shown in a document fed onto the glass surface of the reading table 111 and a document size detector 1202 for determining the size of the document showing the image read by the reading element 1201. The image read by the process performed by the reading mechanism 1200 is sent as read data to an image forming section 1300.

The image forming section 1300 creates image data in output format for image formation and transmission, based on the read data received from the reading mechanism 1200. The image forming section 1300 comprises a volatile recording section 1311 such as a flush memory for temporarily storing the created image data in output format. The image data in output format stored in the volatile recording section 1311 is sent to a non-volatile recording section 2003 using a hard disk, and the non-volatile recording section 2003 records the image data received from the reading mechanism 1200. In the case where a plurality of pieces of documents are read, an amount of image data in output format corresponding to the plurality of pieces is accumulated in the non-volatile recording section 2003 by repeating the creation of image data in output format in the volatile recording section 1311 and the recording of the image data in the non-volatile recording section 2003. Further, the image data recorded in the non-volatile recording section 2003 is sent to the image forming section 1300, if necessary, and the image forming section 1300 stores the image data received from the non-volatile recording section 2003 in the volatile recording section 1311.

In addition, the image forming section 1300 comprises a printing section 1312 including various units such as a photosensitive drum unit 1301, a charging unit 1302, a light scanning unit 1303, a developing unit 1304, a transfer unit 1305 and a cleaning unit 1305. The printing section 1312 forms an image on a sheet fed from the sheet feeding device 3, based on the image data stored in the volatile recording section 1311, and outputs the sheet.

Moreover, the image forming apparatus 1 comprises an input/output control section 2004 for controlling the operating section 12 including the liquid crystal display section 121; and a communication section 2005, connected to a communication network NW such as a telephone network, for transmitting and receiving facsimile data. Further, the image forming apparatus 1 comprises an open/close detecting section 2006 for detecting the opening/closing state of the respective first storage section 21, second storage section 15, third storage section 16 and fourth storage section 17.

Figure 8A:
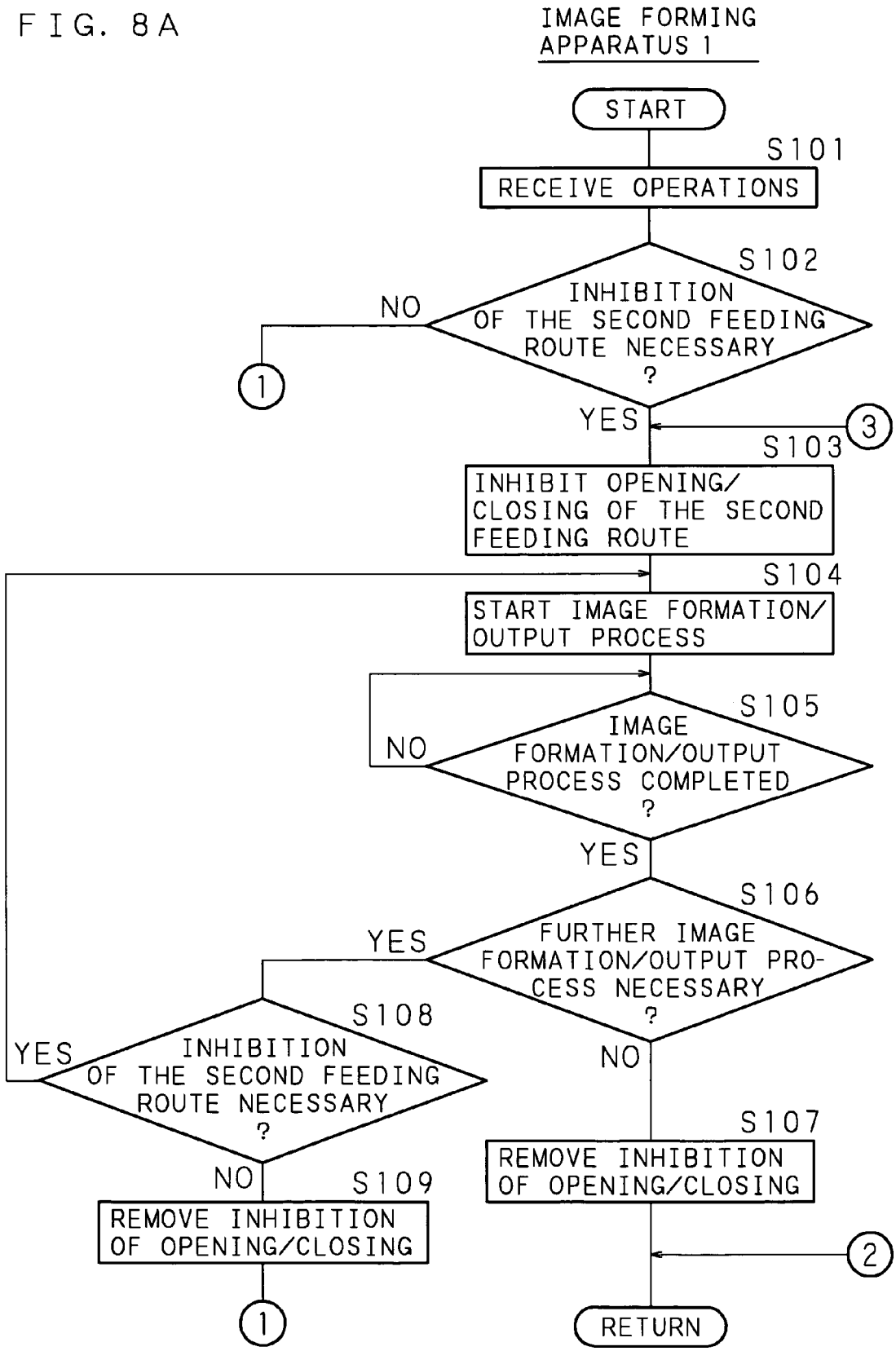
FIG. 8A and FIG. 8B are flowcharts showing an image formation and output process of the image forming apparatus of the present invention.
Figure 8B:
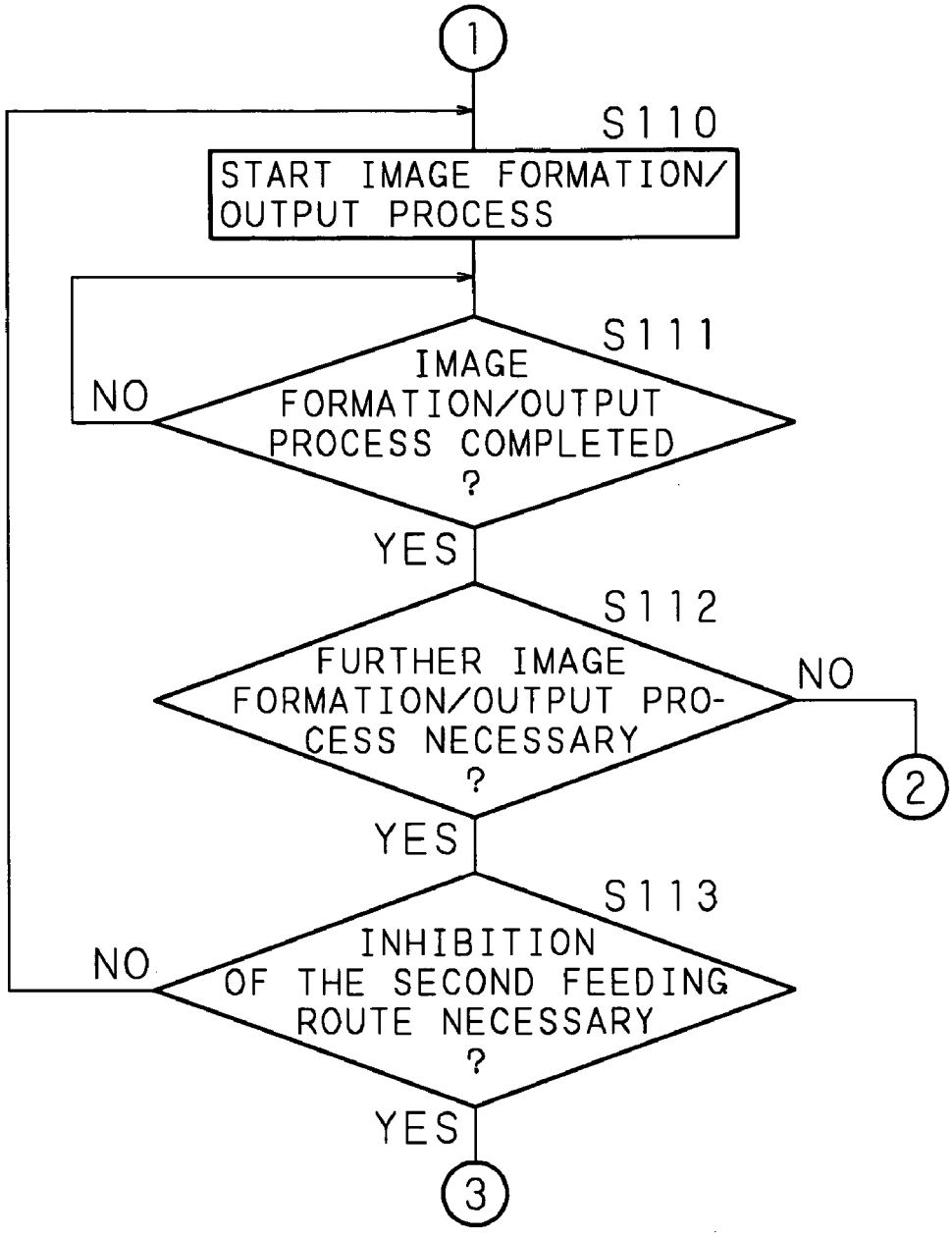

Next, various processes performed by the image forming apparatus 1 of the present invention will be explained. FIG. 8A and FIG. 8B are flowcharts showing an image formation and output process of the image forming apparatus 1 of the present invention. When an operator who operates the image forming apparatus 1 desires to start the image formation and output process on a sheet, the operator places a document on the reading device 11 and operates the operating section 12 to input and specify the number of copies to be made and a size of the sheet or a storage section, and then presses the start key 126 to start the image formation and output process. Here, the following processes are explained on the supposition that the operator performs an operation to form an image on a sheet of a size stored in the first storage section 21.

In the sheet feeding device 3 of the image forming apparatus 1, under the control of the equipment control section 2001, various operations such as an operation to start the image formation and output process are received (step S101), and a determination is made as to whether or not a received operation, or a process to be executed based on the received operation, satisfies a preset predetermined condition and it is necessary to inhibit opening and closing of the second feeding route 1802 (step S102).

The preset predetermined condition in step S102 means a condition indicating feeding of the sheet in a feeding route, and examples of the condition include receiving of operations such as pressing the start key 126 and specifying the first storage section 21 as a sheet on which an image is to be formed; and processes such as starting the feeding of the sheet via the second feeding route 1802, and detection of feeding by the feed detecting section 1802*a*provided just before the connection to the second feeding route 1802. When such a condition is satisfied, it is determined that there is a need to inhibit opening and closing of the second feeding route 1802.

In step S102, under the control of the equipment control section 2001, if the sheet feeding device 3 of the image forming apparatus 1 determines that it is necessary to inhibit opening and closing of the second feeding route 1802 (step S102: YES), it energizes the solenoid 1802*n* as a part of the inhibition unit and produces a locked state in which the lock lever 1802*l* is locked with the protruding portion 1802*k* protruding from the other end of the movable plate 1802*e* constituting the second feeding route 1802, i.e., a state in which opening and closing of the second feeding route 1802 interlocked with opening and closing of the second storage section 15 that is the opening/closing section are inhibited (step S103). Thereafter, the sheet feeding device 3 starts an image formation and output process in which a sheet is fed to the image formation section 1300 from the first storage section 21 via the second feeding route 1802 and second feeding route 1802, an image is formed on the sheet, and the sheet is discharged from a first discharge section 31 or second discharge section 13 (step S104).

Note that the above explanation illustrates an embodiment in which, when it is determined that a sheet such as copy paper is fed from the manual-feed tray 18 or the first storage section 21 via the second feeding route 1802, the solenoid 1802*n* that is the inhibition unit is energized, and opening and closing of the second feeding route 1802 are inhibited, but the present invention is not limited to this embodiment and may be constructed to detect a specific operation such as a rotation of the spindle 1802*g* having the transport rollers 1802*f* in the second feeding route 1802 and a rotation of other component necessary for transport such as transport means, and operate the inhibition unit by mechanical operation. In this case, image formation using the second feeding route 1802 is controlled not to be performed when a specific operation of a component necessary for transport is being executed.

Thus, by inhibiting opening and closing of the second feeding route 1802 interlocked with opening and closing of the second storage section 15 that is the opening/closing section when a sheet stored in the first storage section 21 is being fed in the second feeding route 1802 for formation of an image on the sheet, even if the second storage section 15 is opened (pulled out), the second feeding route 1802 does not open and a feeding malfunction does not occur, and therefore it is possible to perform an operation such as filling the second storage section 1801 with the sheets.

Moreover, since the device is in the unlocked state before feeding is started, it is possible to readily perform operations such as maintenance and supplying of sheets prior to operating the apparatus, and it is also possible to expect the effect of saving power because there is no need to keep energizing the solenoid 1802*n* by providing a period of the unlocked state.

Further, the solenoid 1802*n* is energized and the device is brought into the locked state only when a sheet is fed via the second feeding route 1802 from the first storage section 21 and manual-feed tray 18. Therefore, during feeding of a sheet stored in a storage section out of the second feeding route 1802, such as the third storage section 16 and fourth storage section 17, since the device is not brought into the locked state, it is possible to perform the operation of supplying sheets during the feeding and expect the effect of saving power.

Then, under the control of the equipment control section 2001, the sheet feeding device 3 of the image forming apparatus 1 determines whether or not an image formation and output process in which a sheet is fed, an image is formed on the fed sheet, and the sheet is discharged has been completed (step S105). If it is determined that the image formation and output process has been completed (step S105: YES), the sheet feeding device 3 determines whether or not it is necessary to perform a further image formation and output process (step S106). If it is determined that a further image formation and output process is not necessary, that is, if other image formation job to perform an image formation and output process has not been received (step S106: NO), the sheet feeding device 3 stops energizing the solenoid 1802*n* and removes the unlocked state, that is, the inhibition of opening and closing of the second feeding route 1802 interlocked with opening and closing of the second storage section 15 that is the opening/closing section (step S107), and finishes the process. If it is determined in step S105 that the image formation and output process has not been completed (step S105: NO), the sheet feeding device 3 executes the process of step S105 again after waiting for a predetermined time.

In step S106, if it is determined that a further image formation and output process is necessary, that is, if other image formation job to perform an image formation and output process has been received (step S106: YES), the sheet feeding device 3 of the image forming apparatus 1 determines whether or not it is necessary to inhibit opening and closing of the second image forming route 1802 in the further image formation and output process (step S108), under the control of the equipment control section 2001. If it is determined that it is necessary to inhibit opening and closing of the second image forming route 1802 (step S108: YES), the sheet feeding device 3 returns to step S104 and repeats the process by starting the further image formation and output process.

In step S108, if it is determined that it is not necessary to inhibit opening and closing of the second image forming route 1802 (step S108: NO), the sheet feeding device 3 of the image forming apparatus 1 removes the inhibition of opening and closing (step S109), and starts the image formation and output process of feeding a sheet, forming an image on the fed sheet and discharging the sheet (step S110), under the control of the equipment control section 2001.

Then, under the control of the equipment control section 2001, the sheet feeding device 3 of the image forming apparatus 1 determines whether or not the image formation and output process has been completed (step S111), determines whether or not it is necessary to perform a further image formation and output process (step S112) if it is determined that the image formation and output process has been completed (step S111: YES). The sheet feeding device 3 finishes the process if it is determined that a further image formation and output process is unnecessary (step S112: NO). In step S111, if it is determined that the image formation and output process has not been completed (step S111: NO), the sheet feeding device 3 executes the process of step S111 again after waiting for a predetermined time.

In step S112, if it is determined that a further image formation and output process is necessary (step S112: YES), the sheet feeding device 3 of the image forming apparatus 1 determines whether or not it is necessary to inhibit opening and closing of the second feeding route 1802 in the further image formation and output process (step S113), and returns to step S110 and repeats the process by starting the further image formation and output process if it is determined that it is not necessary to inhibit opening and closing of the second feeding route 1802, under the control of the equipment control section 2001.

In step S113, if it is determined that it is necessary to inhibit opening and closing of the second feeding route 1802 (step S113: YES), the sheet feeding device 3 moves to step S103 and repeats the subsequent processes.

In step S102, if it is determined that the process of inhibiting opening and closing of the second feeding route 1802 is unnecessary (step S102: NO), the sheet feeding device 3 moves to step S110 and repeats the subsequent processes.

Note that the above-described image formation and output process merely illustrates one embodiment of the present invention applicable to a variety of processes, but the present invention is not limited to this process. For example, in the above-described embodiment, when one image formation job has been finished, it is determined whether or not it is necessary to perform a further image formation and output process, and then it is determined whether or not it is necessary to inhibit opening and closing of the second feeding route 1802, but the present invention is not limited to this and may be implemented by controlling the device to remove the inhibition of opening and closing of the second feeding route 1802 immediately after completion of one image formation job, and then determine whether or not it is necessary to perform a further image formation and output process, and inhibit opening and closing of the second feeding route 1802 when a request is made for image formation using the second feeding route 1802.

Figure 9:
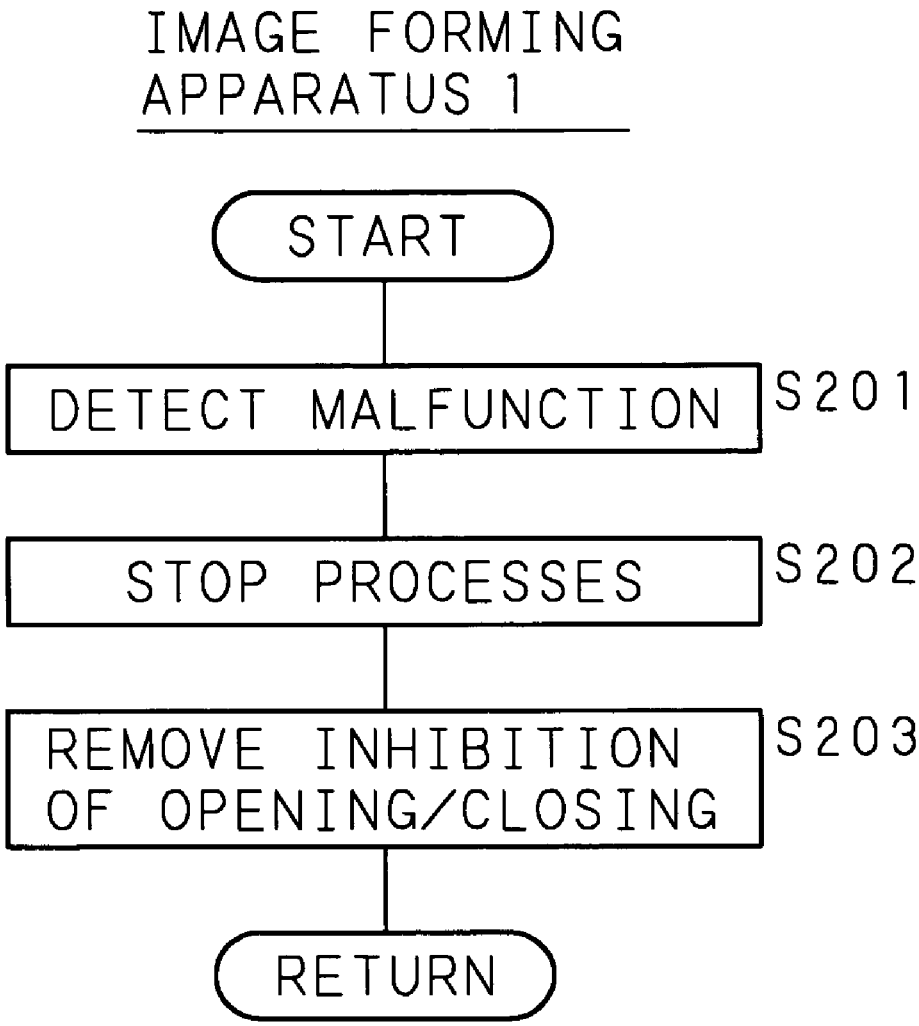
FIG. 9 is a flowchart showing a process performed when a malfunction occurs in the image forming apparatus of the present invention.

FIG. 9 is a flowchart showing a process performed when a malfunction occurs in the image forming apparatus 1 of the present invention. When the sheet feeding device 3 of the image forming apparatus 1 detects a malfunction by the malfunction detection section 1801*a* (step S201), it stops various processes such as feeding of a sheet and an image formation and output process (step S202), stops energizing the solenoid 1802*n* that is a part of the inhibition unit and removes the inhibition of opening and closing of the second feeding route 1802 interlocked with opening and closing of the second storage section 15 that is the opening/closing section (step S203), under the control of the equipment control section 2001.

By removing the inhibition of opening and closing of the second feeding route 1802, the second feeding route 1802 opens and closes in an interlocked manner with opening/closing of the second storage section 15, and therefore it is possible to easily perform a restoration operation against malfunctions such as a sheet jam in the second feeding route 1802. Note that, when the interrupted process is resumed after completion of the restoration operation, needless to say, opening and closing are inhibited again.

The above-described embodiment illustrates a mode in which, when a malfunction is detected with the malfunction detecting section for detecting malfunctions in the second feeding route, the inhibition of opening and closing of the second feeding route interlocked with opening and closing of the second storage section is removed, but the present invention is not limited to this, and, when any one of various malfunction detecting means in the image forming apparatus 1 or in the sheet feeding device 3 detects a malfunction, the inhibition of opening and closing is removed. Besides, when a malfunction occurs under the condition where the malfunction detecting means does not work, for example, during a blackout, the solenoid is not energized unless an auxiliary power is provided, and therefore the inhibition of opening and closing is removed.

Moreover, although the above-described embodiment explains the apparatus that inhibits the second storage section from being opened when an image formation and output process is being performed by supplying a sheet stored in the first storage section, the present invention is not limited to this embodiment, and can be applied to other embodiment if the invention is implemented by a device in which, when an image formation and output process is being performed by supplying a sheet stored in one storage section, opening of other storage section is inhibited.

Further, although the above-described embodiment illustrates a mode in which the opening/closing section is the second storage section, the present invention is not limited to this, and can be applied to an image forming apparatus and a sheet feeding device designed to open/close the-feeding route in an interlocked manner with an opening/closing section other than storage sections, such as an opening and closing door.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet feeding device comprising:

an opening/closing section capable of being opened and closed;

a feeding route for feeding a sheet on which an image is formed, said feeding route capable of being opened and closed in an interlocked manner with opening and closing of said opening/closing section; and an inhibition unit for inhibiting opening and closing of said feeding route during opening and closing of said opening/closing section when a predetermined condition is satisfied.

2. The sheet feeding device according to claim 1, wherein said predetermined condition is a condition indicating feeding of a sheet in the feeding route.

3. The sheet feeding device according to claim 1, wherein said feeding route is a route used for feeding a sheet from a first storage section storing sheets to an image forming section for forming an image on a sheet, and said opening/closing section capable of being opened and closed is a second storage section different from said first storage section and capable of being pulled out and pushed in.

4. The sheet feeding device according to claim 2, wherein said feeding route is a route used for feeding a sheet from a first storage section storing sheets to an image forming section for forming an image on a sheet, and said opening/closing section capable of being opened and closed is a second storage section difference from said first storage section and capable of being pulled out and pushed in.

5. The sheet feeding device according to claim 2, comprising a detector for detecting malfunctions, wherein said inhibition unit removes the inhibition of said feeding route when said detector detects a malfunction.

6. The sheet feeding device according to claim 3, comprising a detector for detecting malfunctions, wherein said inhibition unit removes the inhibition of said feeding route when said detector detects a malfunction.

7. The sheet feeding device according to claim 4, comprising a detector for detecting malfunctions, wherein said inhibition unit removes the inhibition of said feeding route when said detector detects a malfunction.

8. The sheet feeding device according to claim 5, wherein said feeding route comprises a fixed stationary plate and a movable plate mounted swingably on said stationary plate at one end and, said feeding route opens and closes by moving other end of said movable plate apart from or to come into contact with said stationary plate.

9. The sheet feeding device according to claim 6, wherein said feeding route comprises a fixed stationary plate and a movable plate mounted swingably on said stationary plate at one end, and said feeding route opens and closes by moving other end of said movable plate apart from or to come into contact with said stationary plate.

10. The sheet feeding device according to claim 7, wherein said feeding route comprises a fixed stationary plate and a movable plate mounted swingably on said stationary plate at one end, and said feeding route opens and closes by moving the other end of said movable plate apart from or to come into contact with said stationary plate.

11. An image forming apparatus comprising:

a sheet feeding device; and a section for forming an image on a sheet fed by said sheet feeding device, wherein said sheet feeding device comprises:

an opening/closing section capable of being opened and closed;

a feeding route for feeding a sheet on which an image is formed, said feeding route capable of being opened and closed in an interlocked manner with opening and closing of said opening/closing section; and an inhibition unit for inhibiting opening and closing of said feeding route during opening and closing of said opening/closing section when a predetermined condition is satisfied.

12. The image forming apparatus according to claim 11, wherein said predetermined condition is a condition indicating feeding of a sheet in the feeding route.

13. The image forming apparatus according to claim 11, wherein said feeding route is a route used for feeding a sheet from a first storage section storing sheets to an image forming section for forming an image on a sheet, and said opening/closing section capable of being opened and closed is a second storage section different from said first storage section and capable of being pulled out and pushed in.

14. The image forming apparatus according to claim 12, wherein said feeding route is a route used for feeding a sheet from a first storage section storing sheets to an image forming section for forming an image on a sheet, and said opening/closing section capable of being opened and closed is a second storage section different from said first storage section and capable of being pulled out and pushed in.

15. The image forming apparatus according to claim 12, wherein said sheet feeding device comprises a detector for detecting malfunctions, and said inhibition unit removes the inhibition of said feeding route when said detector detects a malfunction.

16. The image forming apparatus according to claim 13, wherein said sheet feeding device comprises a detector for detecting malfunction, and said inhibition unit removes the inhibition of said feeding route when said detector detects a malfunction.

17. The image forming apparatus according to claim 14, wherein said sheet feeding device comprises a detector for detecting malfunctions, and said inhibition unit removes the inhibition of said feeding route when said detector detects a malfunction.

18. The image forming apparatus according to claim 15, wherein said feeding route comprises a fixed stationary plate and a movable plate mounted swingably on said stationary plate at one end, and said feeding route opens and closes by moving other end of said movable plate apart from or to come into contact with said stationary plate.

19. The image forming apparatus according to claim 16, wherein said feeding route comprises a fixed stationary plate and a movable plate mounted swingably on said stationary plate at one end, and said feeding route opens and closes by moving other end of said movable plate apart from or to come into contact with said stationary plate.

20. The image forming apparatus according to claim 17, wherein said feeding route comprises a fixed stationary plate and a movable plate mounted swingably on said stationary plate at one end, and said feeding route opens and closes by moving other end of said movable plate apart from or to come into contact with said stationary plate.

21. A sheet feeding device comprising:

a sheet storage section shiftable between an open position and a closed position;

a sheet transport path for transporting sheets away from said sheet storage section, said sheet transport path being shiftable between a closed position for transporting sheets and an open position for clearing jammed sheets; and an inhibition unit shiftable between first and second positions;

wherein, when said inhibition unit is in said first position, shifting said paper storage section from said closed position to said open position shifts said sheet transport path from said closed position to said open position, and when said inhibition unit is in said second position, said inhibition unit maintains said sheet transport path in said closed position when said sheet storage section shifts from said closed position to said open position, said inhibition unit shifting from said first position to said second position when a predetermined condition is satisfied.

* * * * *